US007963243B2

(12) United States Patent
Quigley

(10) Patent No.: US 7,963,243 B2
(45) Date of Patent: Jun. 21, 2011

(54) PORTABLE COLLAPSIBLE BOAT

(75) Inventor: William Joseph Quigley, Columbus, OH (US)

(73) Assignee: William J. Quigley, Princeton, NJ (US)

( * ) Notice: Subject to any disclaimer, the term of this patent is extended or adjusted under 35 U.S.C. 154(b) by 282 days.

(21) Appl. No.: 12/229,908

(22) Filed: Aug. 28, 2008

(65) Prior Publication Data

US 2010/0050922 A1 Mar. 4, 2010

(51) Int. Cl.
*B63B 35/00* (2006.01)

(52) U.S. Cl. ..... 114/347; 114/352; 114/354

(58) Field of Classification Search ..... 114/347, 114/352, 354

See application file for complete search history.

(56) References Cited

U.S. PATENT DOCUMENTS 3,787,911 A * 1/1974 Miya ..... 114/352
3,822,427 A * 7/1974 Ewart, Jr. ..... 114/352
4,331,093 A * 5/1982 Moller ..... 114/39.14
4,480,579 A * 11/1984 Masters ..... 114/347
2005/0241562 A1* 11/2005 Nysether et al. ..... 114/347

* cited by examiner

*Primary Examiner* — Stephen Avila

(57) ABSTRACT

The invention is a portable collapsible boat comprising one or more rigid cockpit sections, constructed of a material such as fiberglass, attached to a bow section and a stem section, which are constructed of fabric material covering a skeleton of longitudinal stringers and ring frames, and are attached to the rigid cockpit section(s) by means of a belt, buckles, and/or flanges. The hybrid folding boat combines the best features of rigid boats, such as performance and durability, with the best features of existing folding boats, such as transportability, without suffering from the drawbacks of rigid boats (mainly the extensive storage space required) or folding boats (mainly weight). The hybrid folding boat is lighter, easier to transport, more rugged, safer, easier to assemble, and stiffer than previous folding boats, adapts easily to a sailing rig, and facilitates one or more passengers. Manufacture of the boat is simpler than that of conventional folding kayaks because it has fewer parts and less dependence on precision stitching of the fabric covering.

15 Claims, 6 Drawing Sheets

PORTABLE COLLAPSIBLE BOAT

FIELD OF THE INVENTION

This invention relates to a portable collapsible boat having a rigid cockpit section and skin-on-frame bow and stem sections. More particularly, the invention relates to a portable collapsible boat having particular utility as a kayak configurable for one or more than one paddler.

BACKGROUND OF THE INVENTION

Various proposals have been made to provide portable collapsible boats, ranging from rigid hull boats having detachable hull sections to flexible hull boats having a complete take-apart skeleton frame with removable skin. Both types of proposals have significant disadvantages.

Conventional collapsible boats having rigid hulls rely on two or more rigid hull sections that couple or connect to form a boat. Collapsible boats having rigid hulls are durable, lightweight and stiff, but they either take up a significant amount of space when disassembled if the parts do not "nest" within each other, or they are severely constrained in their shape if the parts do nest within each other.

Conventional collapsible boats having flexible hulls incorporate a skin-on-frame construction comprising a frame used to form the outer shape of the hull and an impermeable skin stretched over the frame. Some of the better known types are assembled from a plurality of disconnected stringers and frames which are joined together to form a relatively loose framework. The skin is usually a one piece skin having bow and stem-shaped pockets. The skin receives two halves of the framework, which are then rigidly coupled or connected together inside the skin.

While portable collapsible boats having flexible hulls require little storage space and are easily transportable when collapsed, they suffer from several disadvantages. The skin-on-frame construction of flexible hull boats is disadvantageous because:

- significant time and effort is required for assembly,
- structure lacks rigidity, resulting in poor performance,
- skin is fragile, particularly in the area where the operator's weight is concentrated,
- internal parts such as foot braces, seats, and padding are difficult to affix to the inside of the boat's flexible hull,
- extra equipment is required to convert the boat to sail, rather than paddle use,
- design lacks flexibility to accommodate both a single operator configuration and a multiple operator configuration,
- the overall weight is greater than that of rigid boats of the same type and size.

Thus, there is a need for a portable collapsible boat that requires little storage space, is light in weight, is easy to assemble and disassemble, has good structural rigidity, is durable and performs well.

SUMMARY OF THE INVENTION

The invention relates to a boat that combines the best features of rigid hull boats with the best features of flexible hull boats without suffering from the drawbacks of rigid boats or folding boats. The present invention is easy to assemble and transport, lightweight, durable and rigid. Furthermore, the boat in accordance with the present invention easily adapts from paddling to sailing use and easily adapts from a single to a multiple passenger configuration.

The present invention is a boat comprised of a plurality of sections constructed of different materials. The boat is comprised of one or more rigid cockpit sections fastened, connected, or coupled together, with the bow and stem sections fastened, connected, or coupled to the rigid cockpit section. The rigid cockpit section is constructed from materials such as plastic, fiberglass, carbon fiber, or wood. The bow and stem sections have flexible hulls of a skin-on-frame construction.

The boat of the present invention comprises one or more rigid cockpit sections that may be fastened together by conventional mechanical means such as bolts or draw latches. In the preferred embodiment, the cockpit sections are detachably fastened together to provide versatility in the configuration of the rigid cockpit section. The cockpit sections are comprised of a rigid hull and rigid bulkheads, constructed of materials such as fiberglass, carbon fiber, plastic or wood. The bulkheads at the end of the cockpit sections form separate compartments with respect to the other sections of the boat and prevent water from entering the bow or stem sections in the event of a capsize, making the boat more seaworthy. The bulkheads also obviate the need for a watertight connection between sections.

In the present invention, the bow and stem sections are operatively connected to the rigid cockpit section. The connection of the bow and stem sections to the rigid cockpit section may be fixed or detachable. In the preferred embodiment, the bow and stem sections are detachably connected to the rigid cockpit section so that storage and transport are improved.

The most significant improvement in the boat of the present invention is in the strength and stiffness of the hull. Any boat, when riding over waves, behaves the same as a column in compression. Euler's formula for compression on a column is $$W=(Pi/L)\hat{}2\ EI,$$

where W is force required to buckle the column, Pi is approximately 3.14 , L is the length of an unsupported panel of the column, I is the moment of inertia of the column, and E is the modulus of elasticity of the material of the column. Assuming E and I are 10 units, and the typical folding boat is 18 feet long:

$$W=(3.14/18)\hat{}2*10*10$$

$$W=3$$

Meaning that a typical folding boat of 18 feet length will buckle under a compressive force of 3 units. The portable collapsing boat, when riding over waves, behaves the same as two columns of much smaller length. For example, if the rigid cockpit section is 4 feet long, and the total length of the boat is the same 18 feet as in the last example, then the bow and stem sections are each 7 feet long:

$$W=(3.14/7)\hat{}2*10*10$$

$$W=20$$

The compressive force required to buckle either the bow or stem is 20 units, or almost 7 times as much force as required in the prior example.

The result is that the portable collapsible boat of the present invention may be constructed using significantly lighter materials for the stringers of the bow and stern, and still be stiffer, which means that less effort is required to propel the boat through the water or carry the boat to and from the water. In addition, the weight per foot of conventional folding boats is higher than the weight per foot of rigid boats, which implies that the rigid cockpit decreases the overall weight of the new portable collapsible boat. Lastly, manufacture of the new portable collapsible boat is simpler than that of conventional folding boats because it has fewer parts and less dependence on precision stitching of the skin, because the skins cover a much smaller volume than in a conventional folding boat.

The present invention offers other advantages over boats in the prior art. First, in the prior art, boats have a fixed configuration for either a single paddler or two paddlers. The boat of the invention can be configured to have either a single cockpit section for a single paddler, or multiple cockpit sections for multiple paddlers. Typically conversion of a skin-on-frame boat to sail power involves installation of an extensive amount of equipment to make the boat rigid enough to support a mast, a daggerboard or centerboard, and some type of floatation device such as outriggers or a pontoon on crossarms for stability. The boat of the invention can be quickly and easily configured from paddling use to sailing use, because the rigid cockpit section provides a natural solid mounting point for mast, daggerboard, and outriggers. The bow and stem sections can be collapsed and stowed within the cockpit sections for storage and transport. The invention may be described with greater clarity and particularly by reference to the accompanying drawings.

BRIEF DESCRIPTION OF THE DRAWINGS

Referring now to the drawings wherein like reference numerals refer to like parts throughout the several views.

DETAILED DESCRIPTION OF ILLUSTRATIVE EMBODIMENTS

Figures 1, 2:
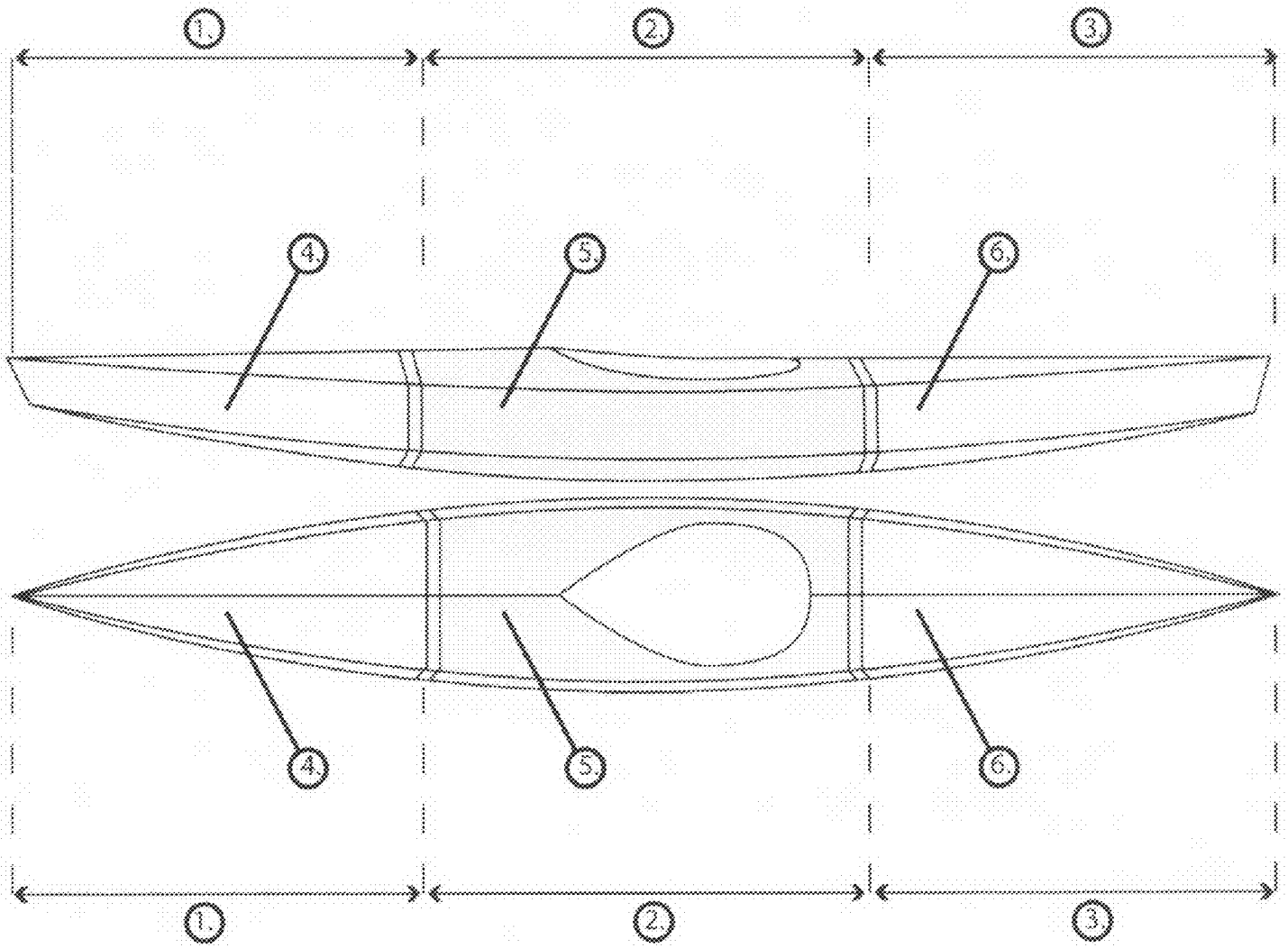
FIG. 1 is a side view of an assembled boat in accordance with the present invention.
FIG. 2 is a top view of the assembled boat shown in FIG. 1.

Referring now to FIGS. 1 and 2: (1) is the bow section, (2) is the rigid cockpit section, (3) is the stem section, (4) and (6) are the flexible skins of the bow and stem sections, and (5) is the rigid hull of the cockpit section of the boat of the present invention.

Figures 3, 4:
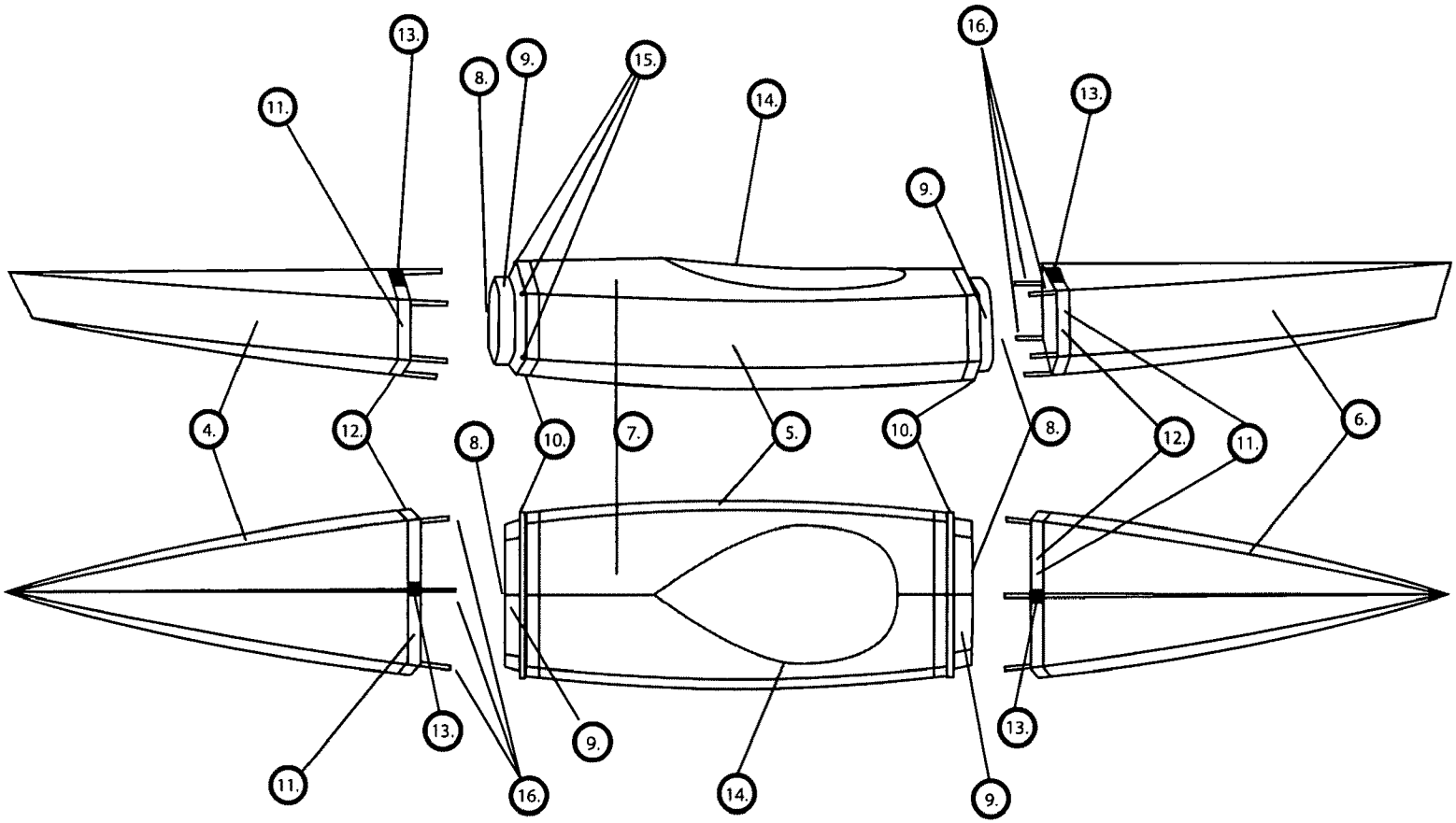
FIG. 3 is a side view of the boat shown in FIG. 1 with the bow and stern sections detached from the rigid cockpit section.
FIG. 4 is a top view of the boat shown in FIG. 3 with the bow and stern sections detached from the rigid cockpit section.

As shown in FIGS. 3 and 4, (7) is the rigid partial deck of the rigid cockpit section (2), (8) are the rigid bulkheads at the ends of the rigid cockpit section (2), (9) are the flanges, having the same cross sectional shape as the rigid cockpit section (2) but slightly smaller, (10) are the lips protruding from the circumferential surfaces of the bow and stem ends of the rigid cockpit section (2), (11) are the rigid battens encased within the skin of the bow (1) and stem (3) sections, (12) are the tensioning belts encased within the skin of the bow (1) and stem (3) sections, (13) are the buckles used to fasten the tensioning belts (12), (14) is the spray skirt flange, and (15) are the recesses in the rigid cockpit section that snugly accept the stringers (16) from the bow (1) and stem (3) sections of the boat.

Figure 5:
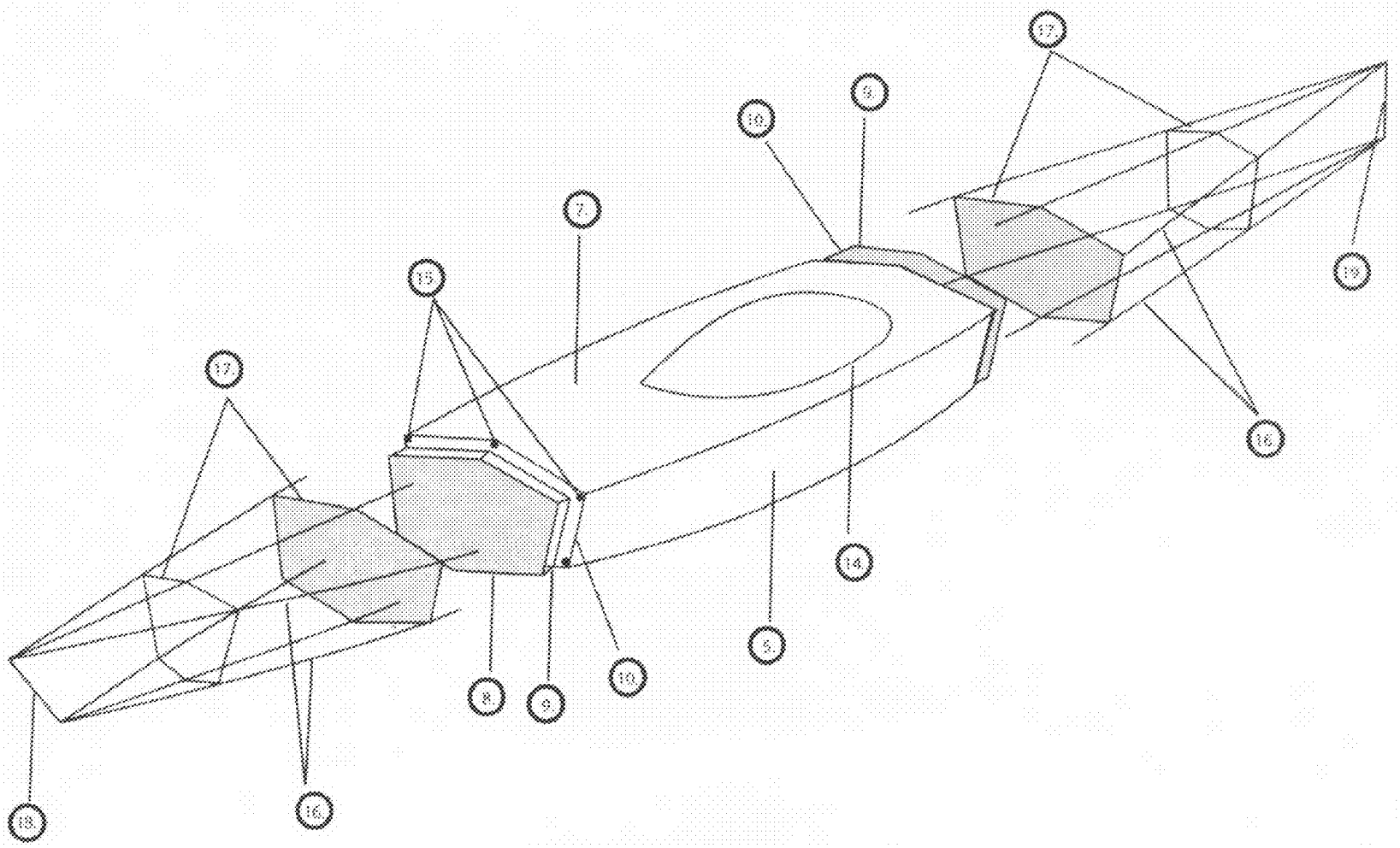
FIG. 5 is a view of the boat with the bow and stern sections detached from the rigid cockpit section and with the skins removed from the bow and stern sections of the boat.

As shown in FIG. 5, (17) are the ring frames in the bow (1) and stem (3) sections, (18) is the bow shape piece, and (19) is the stem shape piece.

Figure 7A:
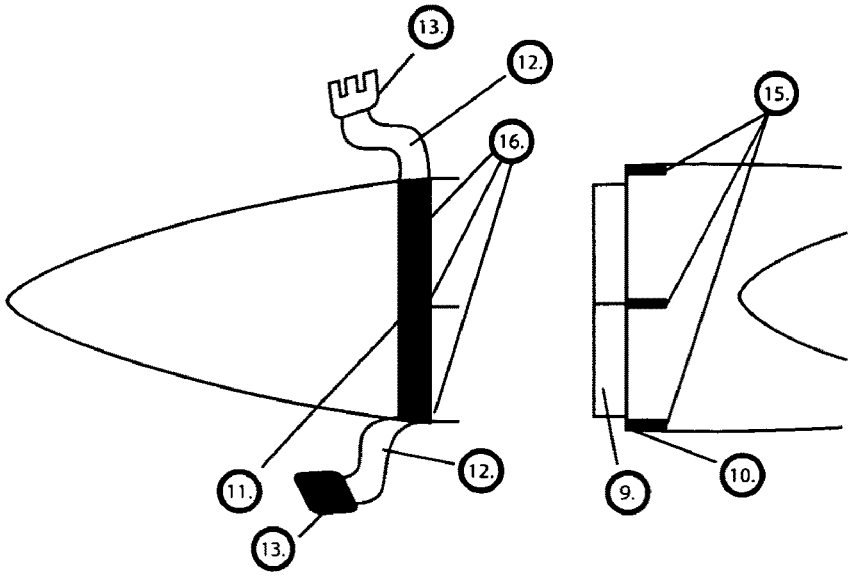
FIGS. 7A, 7B, 7C show a top view demonstrating the joining of the bow section to the rigid cockpit section.
Figure 7B:
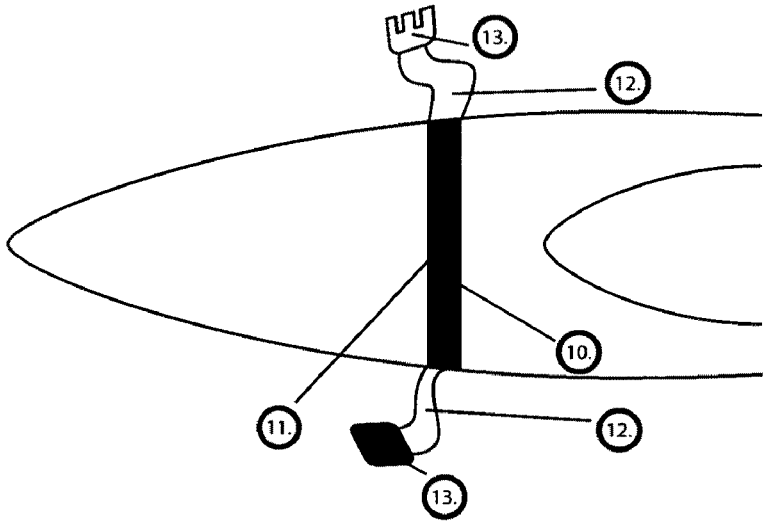
Figure 7C:
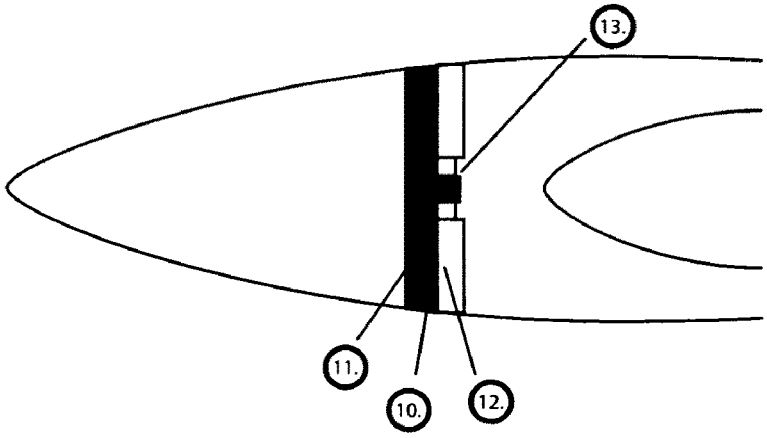

Stringers (16) are lined up with tubes (15), as best seen in FIG. 7*a* . The batten (11) is fitted over the flange (9), as best seen in FIG. 7*b* . In FIG. 7*b* , the tensioning belt (12) is slipped over the lip (10) on the rigid cockpit (2) and is fastened with the buckle (13) as in FIG. 7*c* , which provides a secure seal between the bow section (1) and rigid cockpit section (2).

As indicated, the present invention comprises a boat having a plurality of sections constructed from different materials: a flexible skin (4) bow section (1), a rigid hull (5) cockpit section (2), and a flexible skin (6) stem section (3). The bow (1) and stem (3) sections have a skin-on-frame construction comprising flexible skins (4) (6). The boat comprises a bow (1) and a stem (3) section, and at least one rigid cockpit section (2). In other words, the boat may comprise a bow (1) and a stem (3) section, and one or more rigid cockpit sections (2) joined together. The rigid cockpit sections (2) may be detachably or fixedly connected to each other with conventional mechanical fasteners like nuts and bolts, or latches. In the prior art, boats have a fixed configuration for either a single paddler or two paddlers. Boats that are designed for two paddlers are unmanageable for a single paddler and boats designed for a single paddler cannot accommodate two paddlers. The boat of the invention is advantageous over boats of the prior art because it can be configured to have either a single rigid cockpit section (2) for a single paddler, or multiple rigid cockpit sections (2) for multiple paddlers.

The rigid cockpit section (2) is constructed of materials such as fiberglass, carbon fiber, plastic or wood. The rigid cockpit section (2) is comprised of a rigid hull (5), a rigid partial deck (7) and rigid bulkheads (8). The rigid bulkheads (8) at the ends of the rigid cockpit section (2) form separate compartments with respect to the bow (1) and stem (3) sections of the boat and prevent water from entering the bow (1) and stem (3) sections in the event of a capsize. The solid surfaces of the rigid cockpit section (2) offer various advantages over skin-on-frame boats of the prior art. The rigid cockpit section's (2) rigid partial deck (7) provides a solid surface to incorporate a spray skirt flange (14). Also, the cockpit section's (2) rigid hull (5) and rigid partial deck (7) provide solid surfaces in and on the cockpit for mounting adjustable foot pegs, padding, and deck hardware. Furthermore, the rigid cockpit section (2) allows the option of an integrally formed daggerboard trunk with a mast support bracket and step that requires no additional rigging to convert the boat from paddling use to sailing use. Lastly, the cockpit section's (2) rigid hull (5) and rigid partial deck (7) facilitate the attachment of outriggers or floats to convert the boat to a proa, catamaran, or trimaran.

Figure 6:
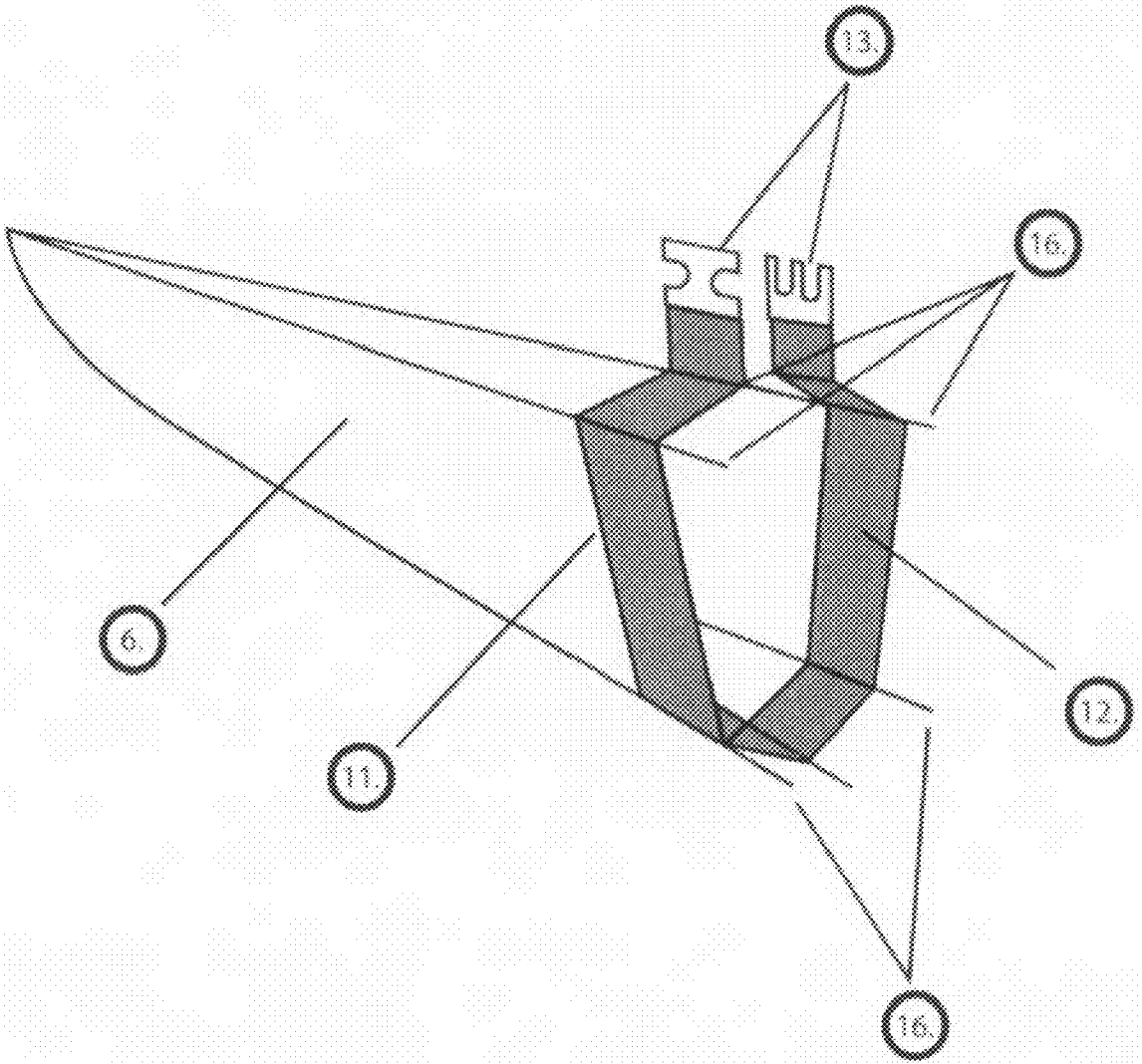
FIG. 6 shows the bow or stern section of the boat.
Figure 8:
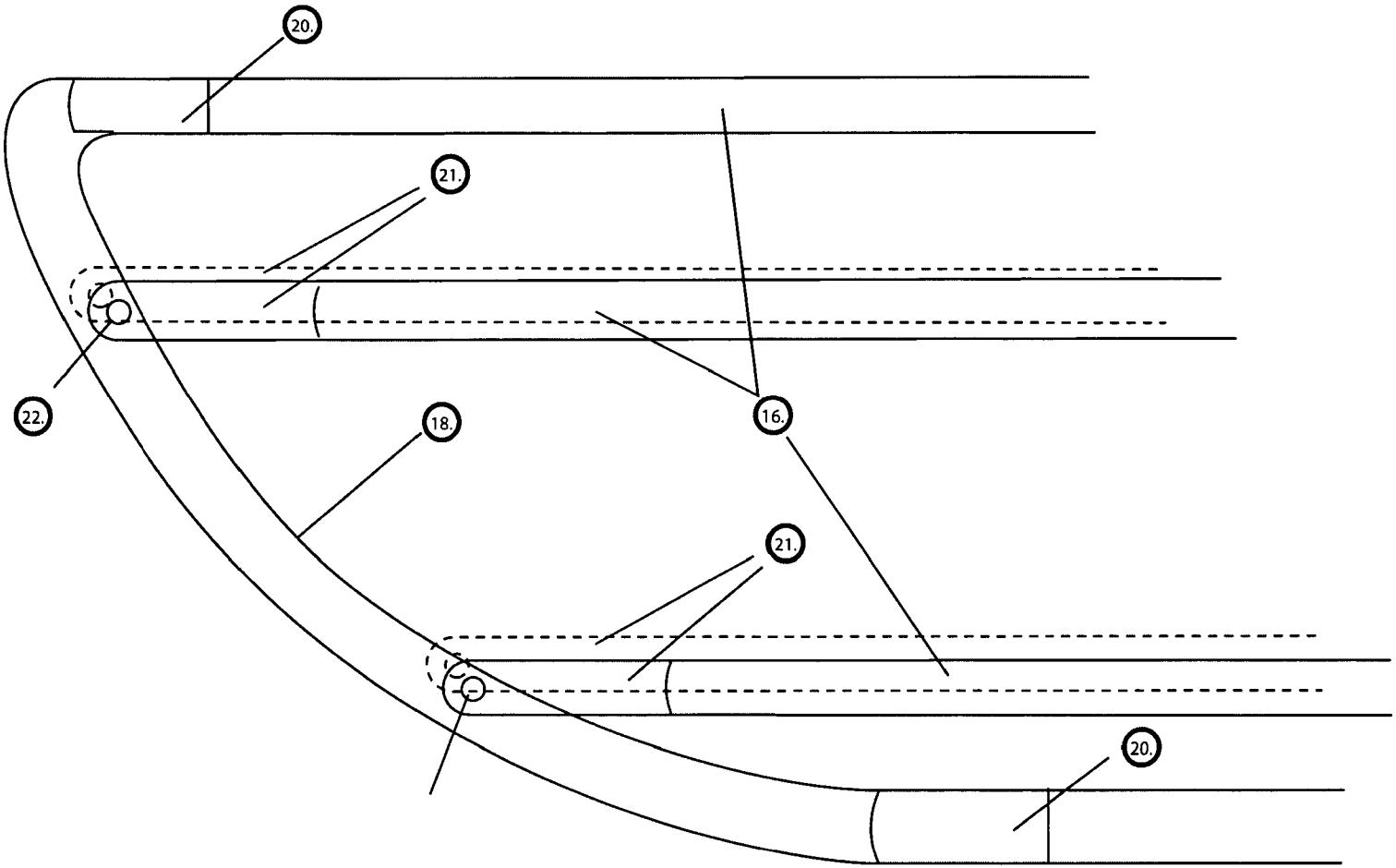
FIG. 8 shows a detail view of the bow or stern section.

The bow (1) and stem (3) sections of the boat have a conventional skin-on-frame construction. The frame comprises stringers (16), ring frames (17), fixed stringer sockets (20), pivoting stringer sockets (21), and a bow shape piece (18) or a stem shape piece (19). FIG. 8 shows the assembly of the stringers (16), fixed stringer sockets (20), pivoting stringer sockets (21), and a bow shape piece (18) or a stem shape piece (19). FIG. 5 shows both the bow (1) and stem (3) section's frame assembly without the skin. FIG. 6 shows a bow (1) or stem (3) section completely assembled and fitted with a skin. The skins of the bow (4) and stem (6) sections are shaped like pockets that snugly receive the assembled frames of the bow (1) and stem (3) sections of the boat. The bow (1) and stem (3) sections may be open-ended where they are connected to the rigid cockpit section (2), or may be enclosed by the skins (4) (6) to form watertight compartments.

In the present invention, the bow (1) and stem (3) sections are operatively fastened to the rigid cockpit section (2). In the preferred embodiment, the bow (1) and stem (3) sections are detachably fastened to the rigid cockpit section (2). The connection for detachably fastening the bow (1) and stem (3) sections to the rigid cockpit section (2) comprises recesses (15) at the ends of the rigid cockpit section (2) for snugly accepting the stringers (16) from the bow (1) and stem (2) sections, a batten (11) encased in the skin of the end section that is fitted over a flange (9) in the cockpit section (2), and a tensioning belt (12) encased in the skin of the end section that is slipped over a lip (10) on the rigid cockpit section (2) and secured with a buckle (13) to form a watertight seal. Alternatively, the connection for detachably fastening the bow (1) and stem (3) sections to the rigid cockpit section (2) comprises a hinge slid into a sleeve at the keel, allowing the bow and stem sections to be pivotably latched to the rigid cockpit section at the gunwales. In other embodiments, the bow (1) and stem (3) sections may be fixedly connected to the rigid cockpit section (2) with conventional mechanical means like bolts, pins or latches.

I claim:

1. A portable collapsible boat having a plurality of sections, and variable number of sections, for purposes of varying the length and carrying capacity: at least one rigid cockpit section, bow and stern sections, at least one of the bow and stern sections having a flexible hull, and connection means for operatively fastening the bow and stern sections to the rigid cockpit section, wherein the bow and stern sections each include an outer skin and stringers, and wherein the connection means for operatively fastening the bow and stern sections to the rigid cockpit section comprises:

recesses in the rigid cockpit section for snugly accepting the stringers of the bow and stem sections, flanges on the bow and stern of the rigid cockpit section, and a batten encased within the skin of the bow and stern sections that is fitted over the flanges of the cockpit.

2. The boat of claim 1, wherein the bow and stern sections having a flexible hull comprise a skin-on-frame construction, which enables disassembly of and storage of the bow and stem sections inside the rigid cockpit section.

3. The boat of claim 1, wherein the bow and stern sections comprise watertight compartments.

4. The boat of claim 1, wherein the cockpit section is made from rigid materials including but not limited to fiberglass, carbon fiber, plastic and wood, and wherein the smaller of the cockpit sections may be stored entirely within another larger cockpit section.

5. The boat of claim 1, wherein the rigid cockpit section comprises a solid hull, solid bulkheads at the bow and stern sections, and a solid partial deck, and wherein the bow and stern sections may be stored entirely within one of the rigid cockpit sections.

6. The boat of claim 1, wherein the bow and stem sections each include an outer skin and stringers, and wherein the connection for detachably fastening the bow and stem sections to the rigid cockpit section comprises:

recesses in the rigid cockpit section for snugly accepting the stringers of the bow and stem sections, lips protruding from the peripheral surface of the bow and stem ends of the rigid cockpit, and tensioning belts encased within the skin of the bow and stem sections that are slipped over the lips of the rigid cockpit section and tightened.

7. The boat of claim 1, wherein the connection means for operatively fastening the bow and stern sections to the rigid cockpit section comprises:

a hinge slid into a sleeve at the keel, allowing the bow and stem sections to be pivotably moved with respect to the rigid cockpit section, and latches at the gunwales of the bow section, stem section and rigid cockpit section for securing the sections together.

8. The boat of claim 1, wherein the rigid cockpit section has a daggerboard trunk or a centerboard trunk.

9. The boat of claim 1, wherein the rigid cockpit section has a mast bracket and a mast step.

10. The boat of claim 1, wherein the rigid cockpit section has braces for attachment of outriggers or floats to convert the boat to a proa, catamaran, or trimaran.

11. The boat of claim 1, wherein the rigid cockpit section has a flange for securing a spray skirt.

12. The boat of claim 1, wherein the rigid cockpit section has footpegs.

13. The boat of claim 1, wherein the rigid cockpit section has deck hardware.

14. A method of configuring the boat of claim 1 to accommodate more than a single paddler, comprises joining two or more rigid cockpit sections together, and joining the bow and stern sections to the combination of two or more rigid cockpit sections.

15. A method of disassembling the boat of claim 1, comprises collapsing the flexible hull bow and stern sections and stowing the collapsed flexible hull bow and stern sections within the rigid cockpit section.

* * * * *